US006138323A

United States Patent [19]

Thøgersen

[11] Patent Number: 6,138,323

[45] Date of Patent: Oct. 31, 2000

[54] FLOOR STRIP SYSTEM FOR LEVELLING THE TRANSITION BETWEEN TWO ABUTTING FLOORINGS

[75] Inventor: Lars Thøgersen, København, Denmark

[73] Assignee: SAS Component, Kastrup, Denmark

[21] Appl. No.: 09/147,080

[22] PCT Filed: Mar. 21, 1997

[86] PCT No.: PCT/DK97/00126

§ 371 Date: Oct. 1, 1998

§ 102(e) Date: Oct. 1, 1998

[87] PCT Pub. No.: WO97/36525

PCT Pub. Date: Oct. 9, 1997

[30] Foreign Application Priority Data

Apr. 1, 1996 [DK] Denmark ..... 0370/96

[51] Int. Cl.[7] ..... A47G 27/04

[52] U.S. Cl. ..... 16/16; 16/4

[58] Field of Search ..... 16/4, 16

[56] References Cited

U.S. PATENT DOCUMENTS

| | | | |
|---|---|---|---|
| 2,557,845 | 6/1951 | Sokolik | 16/16 |
| 2,796,624 | 6/1957 | Speer | 16/16 |
| 3,010,141 | 11/1961 | Grunwald . | |
| 3,696,461 | 10/1972 | Kelly . | |
| 4,156,300 | 5/1979 | Jarjavail . | |
| 4,653,138 | 3/1987 | Carder | 16/16 |
| 4,913,576 | 4/1990 | Grant, Jr. | 16/16 |

FOREIGN PATENT DOCUMENTS

| | | | |
|---|---|---|---|
| 0 188 639 | 1/1985 | European Pat. Off. . | |
| 0 711 886 | 5/1995 | European Pat. Off. . | |
| 0 696 667 | 7/1995 | European Pat. Off. . | |
| 32 23 049 | 6/1982 | Germany . | |
| 32 40 270 A1 | 5/1984 | Germany . | |
| 37 43 895 | 7/1989 | Germany . | |
| 906242 | 9/1962 | United Kingdom | 16/16 |
| 2 257 040 | 1/1993 | United Kingdom . | |
| 2 257 626 | 1/1993 | United Kingdom . | |
| 2 274 055 | 8/1993 | United Kingdom . | |

*Primary Examiner*—Anthony Knight
*Assistant Examiner*—Mark Williams
*Attorney, Agent, or Firm*—Oblon, Spivak, McClelland, Maier & Neustadt, P.C.

[57] ABSTRACT

A floor strip system for leveling the transition between two abutting floor coverings. This system includes a bottom part which is placed on a bottom floor and which has members adapted to project below portions of the respective abutting floor coverings. The system also has a top part which is secured on top of the bottom part. This part projects over portions of the floor coverings. Each member of the bottom part has a side which faces and abuts the floor covering in question. This side has a first surface of a relatively small inclination relative to and away from a side which abuts the bottom floor. This side surface is inclined toward the area adjacent the transition. The side also has a second surface adjacent the edge of the floor coverings which has a relatively larger inclination relative to and away from the side abutting the bottom floor and inclining away from the area adjacent the transition. The top part has a planar top side and is shaped to be complementary to the area between the second surface of each projecting member of the bottom part so that the floor coverings are arranged in a sandwich-like manner between the two parts.

8 Claims, 3 Drawing Sheets

FLOOR STRIP SYSTEM FOR LEVELLING THE TRANSITION BETWEEN TWO ABUTTING FLOORINGS

BACKGROUND OF THE INVENTION

1. Field of the Invention

The invention relates to a floor strip system for levelling the transition between two abutting floor coverings, said floor strip system comprising a bottom part which is placed on a bottom floor below the floor coverings and which is provided with members adapted to project below portions of their respective abutting floor coverings, where said floor strip system further comprises a top part which is secured on top of the bottom part and is provided with members adapted to project over portions of their respective abutting floor coverings.

2. Discussion of the Background

In aircrafts it is known to use a carpet in the aisles of the aircraft and a vinyl covering in other areas. A strip is then provided at the transition between the two coverings so as to protect the edge of the carpet. This strip overlaps portions of both coverings, and in particular the differences of height between the coverings cause the staff of the aircraft a lot of trouble when the cart loaded with articles etc. is to be pushed from the vinyl covering and into the area with the carpet.

Floor strip systems are furthermore known which are arranged at abutting edges of carpets so as to protect said edges. These floor strip systems comprise a bottom part and a top part arranged below and on top of the carpets, respectively, and subsequently connected to one another. These floor strip systems do not facilitate the traffic with heavy carts from one carpet to the next carpet.

SUMMARY OF THE INVENTION

A floor strip system according to the present invention is characterised in that each member of the bottom part is of a substantially triangular section and comprises a top side for facing and abutting the lower surface of the corresponding floor coverings and a substantially plane bottom side for abutting the bottom floor, whereby said top side comprises a first and a second substantially plane surface meeting each other at a transition ridge, whereby the first surface is situated farthest away from the edge of the corresponding covering and has a relatively small inclination relative to the bottom side of the member and whereby the second surface has a relatively considerable inclination relative to the bottom side, and that the top part is provided with a relatively plane top side opposite the bottom part and is shaped essentially complementally relative to the area between the ridges of the members of the bottom part so that the top part is adapted to be received in this area in such a manner that the adjacent part of the two floor coverings can be arranged in a sandwich-like manner between the top part and the bottom part, while the plane top side of the top part is essentially flushing with the upper side of the coverings within the parts of the coverings passing over the ridges.

The resulting floor strip system ensures a smooth and easy transition from one floor covering to the next floor covering. The latter is in particular due to the fact that the members of the bottom part projecting below the two floor coverings ensure a smooth elevation of the two floor coverings to such a level that their surfaces substantially flush with the top side of the top part, said two floor coverings being clamped in a protecting manner below the top part between said top part and the bottom part at a lowered level.

According to the invention, the bottom part and the top part may be mouldings, each moulding being symmetrically structured relative to a longitudinal central plane to be arranged halfway between the two floor coverings, whereby the floor strip system is easy to manufacture of plastics by way of extrusion.

Furthermore according to the invention, the two members of the bottom part may be connected to a relatively thin connecting member which can be removed after the securing onto the bottom floor. The resulting floor strip system allows a particularly low elevation of the surfaces of the floor coverings at the transition in question. The two members of the bottom part may according to the invention optionally be manufactured separately.

According to a particularly advantageous embodiment of the invention, the first surface on the bottom part may present an inclination of approximately 5°, while the second surface presents an inclination of approximately 30°.

According to the invention, the bottom part and the top part may comprise co-operating snapping means for ensuring their interconnection with the result that the securing of the top part can be performed in a particularly simple manner.

Finally according to the invention, the bottom part may be provided with recesses for receiving thread bushings co-operating with bolts which extend through corresponding openings in the bottom part, said thread bushings comprising a circumferential flange abutting the rear side of the bottom part. As a result it is possible to interconnect the bottom part and the top part by means of screws without necessitating a screwing in the bottom floor.

BRIEF DESCRIPTION OF THE DRAWINGS

The invention is explained in detail below with reference to the drawings, in which.

DETAILED DESCRIPTION OF THE PREFERRED EMBODIMENTS

Figure 1:
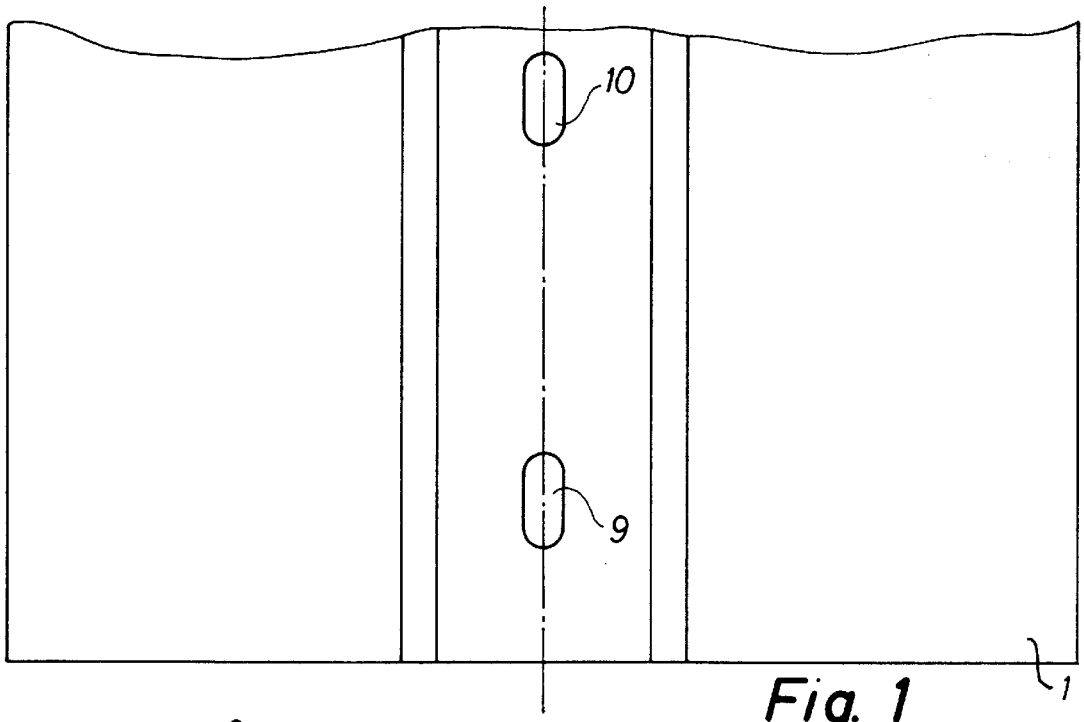
FIG. 1 is a top view of a bottom part in an embodiment of a floor strip system according to the invention.
Figure 2:
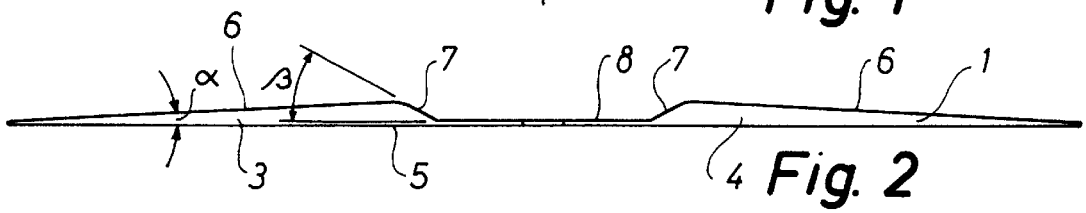
FIG. 2 is an end view of the same embodiment.
Figure 3:
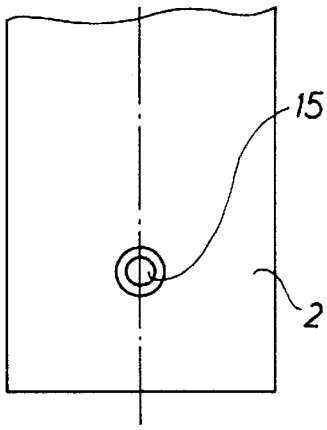
FIG. 3 is a top view of a portion of a top part associated with the bottom part of FIGS. 1 and 2.
Figure 4:
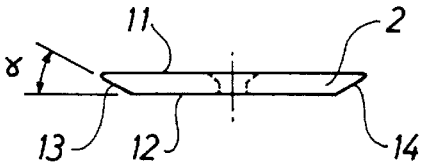
FIG. 4 is an end view of the top part of FIG. 3.

The floor strip system shown in FIGS. 1 to 4 comprises a bottom part 1 and a top part 2 in form of mouldings. The bottom part is symmetrically structured around a central plane being vertical in the use position, and thus said bottom part comprises members 3 and 4, respectively, of an identical cross section and projecting to their respective sides. The bottom side of the bottom parts is adapted to be mounted on top of a bottom floor and is essentially plane. The top sides of each of the two projecting members 3 and 4 comprise a first substantially plane surface 6 arranged farthest away from the central plane, as well as a second substantially plane surface 7 arranged adjacent said central plane. The first plane surface 6 forms an angle $\alpha$ with the bottom side 5 of approximately 5° and inclines towards the central plane in a direction away from said bottom side 5. The second surface 7 forms an angle $\beta$ of approximately 30° with the bottom side 5 and inclines away from said bottom side 5 in a direction away from the central plane. The second surfaces 7 of the two members 3 and 4 extend in parallel when seen in the longitudinal direction and are arranged closer to the central plane than the first surface 6. The two members 3 and 4 are interconnected by means of a thin connecting member 8 with a substantially plane top side. Openings 9 and 10 are centrally provided in an along the bottom part at regular intervals for receiving securing means for the top part in form of screws.

Figure 5:
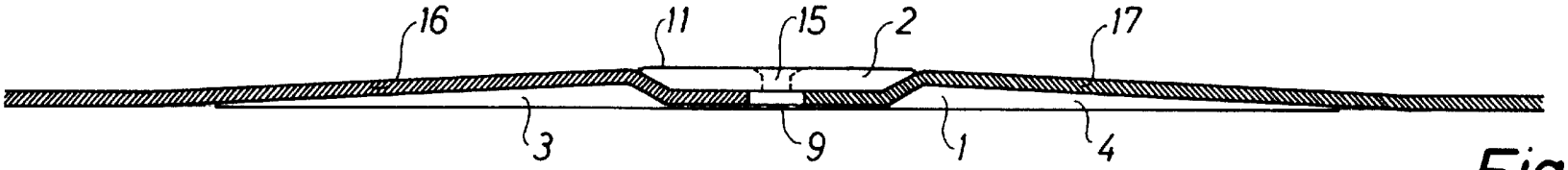
FIG. 5 is an end view of the floor strip system of FIGS. 1 to 4, said system being in the mounted state and shown together with two abutting floor coverings, FIG. 5 being a vertical sectional view of the latter floor coverings.

The top part 2 is also symmetrically formed around a central plane vertically arranged in the mounted state and complementally formed relative to the area between the second surface 7 on the two members 3 and 4 of the bottom part in accordance with the thickness of two abutting floor coverings. As shown in FIG. 5 the latter two abutting floor coverings are to be received between the bottom part 1 and the top part 2 of the floor strip system in the mounted state.

Therefore the top part 2 comprises two parallel sides, viz. a top side 11 and a bottom side 12 as well as two inclining edges 13 and 14. In the mounted state these two inclining edges 13 and 14 extend essentially in parallel to the second surface 7 on the respective two members of the bottom part 1. Thus the inclining edges 13 and 14 form an angle $\gamma$ with the bottom side 12 of approximately 30°.

Openings 15 are centrally arranged at regular intervals in the top part for receiving screws.

The bottom part 1 and the top part 2 are mounted as shown in FIG. 5 with two floor coverings 16 and 17 extending over the two members 3 and 4 of the bottom part 1 in such a manner that the abutting edges of said floor coverings 16 and 17 are arranged approximately at the central plane of the bottom part 1 and the top part 2. The top part 2 is fixedly secured by means of screws extending through the openings 15, 9 and 10, respectively, and downwards into a bottom floor. The bottom part 1 is advantageously secured to the bottom floor by means of adhesive. The two floor coverings 16 and 17 are clamped between the bottom part 1 and the top part 2 as shown, and the top side 11 of the latter is substantially flushing with the highest level of the two floor coverings 16 and 17. As a result, the top part 2 ensures both an easy transition between the two floor coverings and a protection of the edges of said floor coverings.

Figure 6:
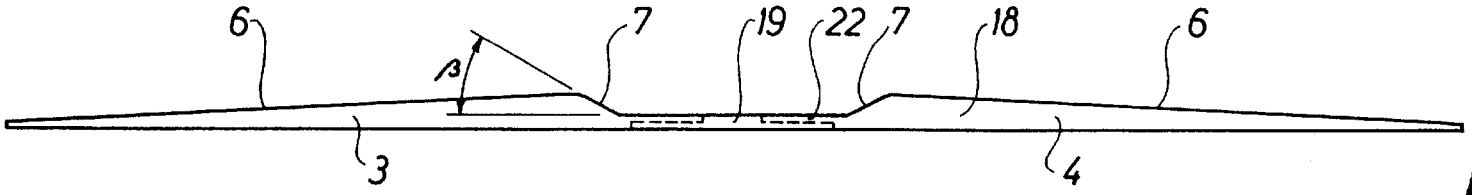
FIG. 6 is an end view of a second embodiment of a bottom part for a floor strip system according to the invention.
Figure 7:
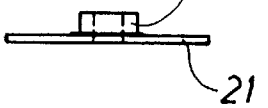
FIG. 7 illustrates a thread bushing to be used together with the bottom part of FIG. 6.

The embodiment shown in FIG. 6 of a bottom part 18 is at regular intervals provided with recesses 19 for receiving thread bushings 20 of the type shown in FIG. 7. These thread bushings 20 are circular and shaped with a projecting circumferential flange 21 which ensures a retaining of the thread bushing at the rear side of the bottom part 18. The bottom part 18 corresponds by the way to the bottom part 1 shown in FIGS. 1 and 2 apart from the fact that it comprises a thicker connecting member 22 allowing the presence of the recesses 19.

Figure 8:
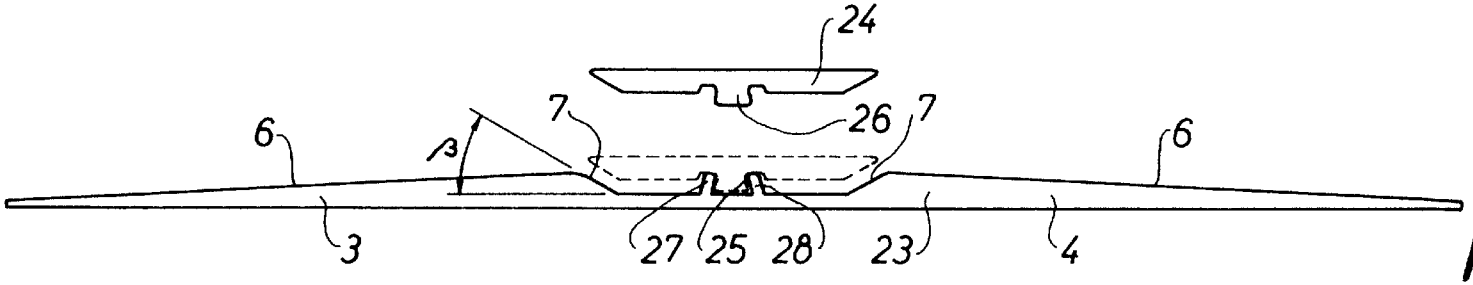
FIG. 8 illustrates yet another embodiment of a floor strip system according to the invention, where the bottom part and the top part are provided with snapping means, and where the top part is shown in a state indicated by full-drawn lines at a distance from the bottom part, and in a state indicated by dotted lines, where it engages the bottom part.

FIG. 8 shows an embodiment of a strip system structured more or less like the embodiment shown in FIGS. 1 to 6 apart from the fact that the bottom part 23 and the top part 24 are shaped with longitudinal co-operating snapping means. These snapping means are in the illustrated embodiment formed by a longitudinal groove 25 provided on the bottom part 23 and of a substantially dovetailed cross section. This groove 25 is adapted to receive a correspondingly shaped longitudinal projection 26 on the top part 24. The groove 25 on the bottom part 23 is defined by longitudinal ribs 27 and 28, each rib being provided with barbs which co-operate with barbs on the corresponding side of the projection 26 on the top part 24. The top part 24 is shown in the mounted state by means of dotted lines.

Figure 9:
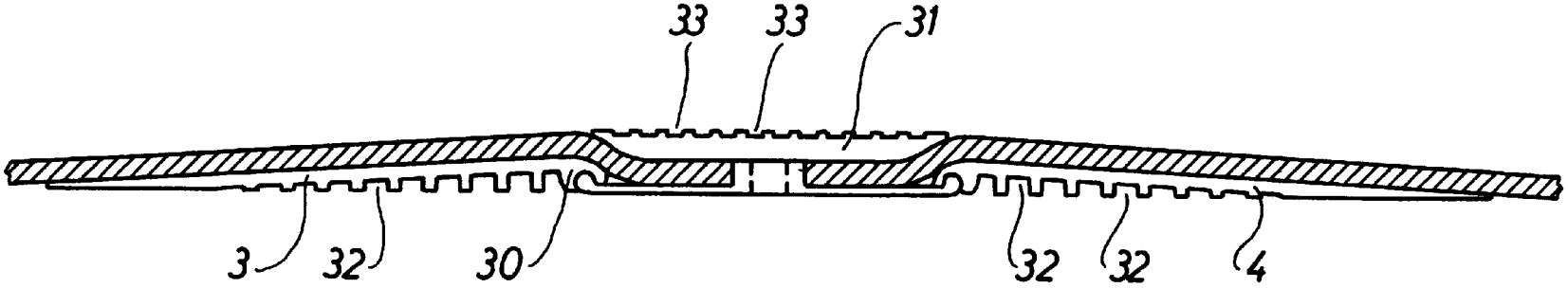
FIG. 9 is an end view of a fourth embodiment of a floor strip system according to the invention, where the bottom part comprises interconnectable sections.
Figure 10:
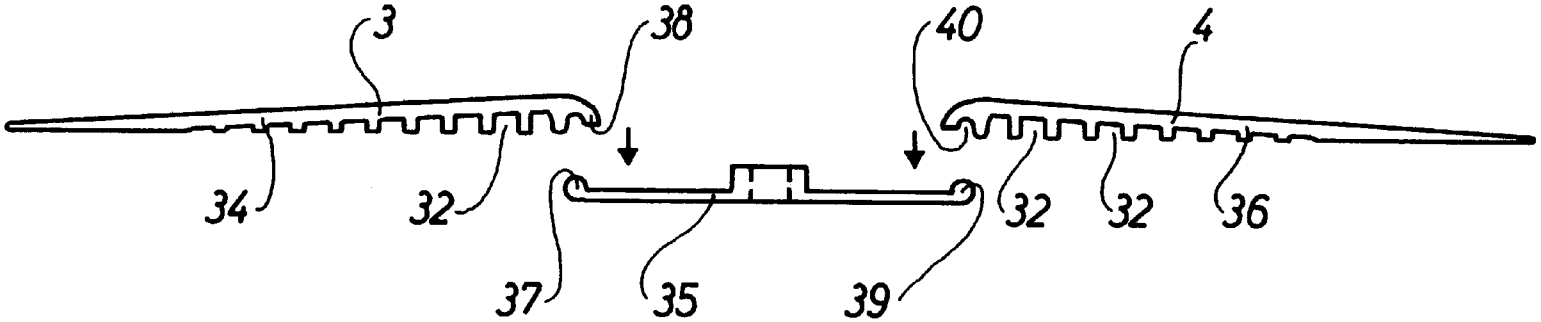
FIG. 10 illustrates the disassembled state of the bottom part of FIG. 9.

The embodiment shown in FIGS. 9 and 10 of a strip system according to the invention comprises a bottom part 30 and a top part 31. Especially for productional reasons these parts 30 and 31 are provided with longitudinal grooves 32 and 33. In addition, the bottom part 30 comprises three extruded bars or section bars 34, 35 and 36, which can be interconnected by means of suitably shaped engagement means 37, 38 and 39, 40. The engagement means 37 to 40 work more or less like fixing means ensuring a correct mutual positioning of the bars 34, 35 and 36. All three bars 34, 35 and 36 are suitably fastened to the bottom floor by way of gluing.

The described floor strips are made of a suitable plastics, and, as mentioned, they are fastened to the bottom floor by way of gluing or another suitable procedure. The floor coverings can be adhered or fastened for instance by means of double surfaced adhesive tape to the bottom part 1, 18 or 23. In the illustrated embodiments the strip system is adapted to receive floor coverings of a substantially uniform thickness. If desired, the parts of the strip system can be adapted such that they are suited for floor coverings of different thicknesses. The latter is achieved by the bottom part being provided with projecting members of different cross sections, but the same inclinations on the surface, of the above description.

According to a preferred embodiment of the invention, the bottom part is of a width of approximately 200 mm, and the connecting member 8, 22 is of a width of approximately 32 mm. The top part is at the top of a width of approximately 40 mm and a thickness of approximately 3.2 mm.

The bottom part of several of the illustrated embodiments comprises connecting members shaped integral with projecting members 3 and 4. In one particular embodiment corresponding to the embodiment of FIGS. 1 to 4, these connecting members can be very thin and optionally be cut off in connection with the mounting procedure. The bottom part can optionally be manufactured without such a connecting member, the two members 3 and 4 thus being separately manufactured. In both cases it is possible to manufacture the top part 2 relatively thicker compared to the situation where the connecting member is present.

What is claimed is:

1. A floor strip system for leveling the transition between two abutting floor coverings, said floor strip system comprising a bottom part which is adapted to be placed on a floor below the abutting edges of the two floor coverings and which is comprised of two members, wherein said floor strip system further comprises a top part which is secured on top of the bottom part and is provided with oppositely inclined lower edges adapted to project over portions of their respective abutting floor coverings, wherein each member of the bottom part comprises a top side for facing and said top side comprises a substantially plane first inclined surface having a relatively small inclination relative to and away from a substantially planar bottom side for abutting the floor, each said first inclined surface inclining towards a transition area between the two members, said top side of each bottom member also comprises a second inclined surface adjacent to an edge of the transition area between said members, each said second inclined surface being of a relatively considerable inclination relative to and away from the planar bottom side and the transition area, and the top part is provided with a relatively planar top side and its bottom surface is shaped essentially complementarily relative to the area between the second inclined surface on each member of the bottom part, whereby the bottom part is positioned below the floor covering while the top part is simultaneously adapted to be received in the transition area in such a manner that the floor coverings can be arranged in a sandwich-like manner between the two parts.

2. A floor strip system as claimed in claim 1, characterised in that the bottom part and the top part are mouldings, each moulding being symmetrically structured relative to a longitudinal central plane to be arranged halfway between the two floor.

3. A floor strip system as claimed in claim 1, wherein the two members of the bottom part are detachably connected to a thin connecting member which can be removed after fastening to the floor.

4. A floor strip system as claimed in claim 1, wherein the two members of the bottom part are detachably connected.

5. A floor strip system as claimed in claim 4, wherein the bottom part is formed by interconnectable, separate extruded bars or section bars.

6. A floor strip system as claimed in claim 1, wherein the first surface on the two members of the bottom part presents an inclination ($\alpha$) of approximately 5°, whereas the second surface presents an inclination ($\beta$) of approximately 30°.

7. A floor strip system as claimed in claim 1, wherein the bottom part and the top part comprise cooperating snapping means for ensuring their interconnection.

8. A floor strip system as claimed in claim 1, wherein the bottom part is provided with recesses for receiving thread bushings cooperating with bolts, said thread bushings each having a circumferential flange for abutment against a rear side of the bottom part.

* * * * *